US008733302B1

(12) United States Patent
Woo et al.

(10) Patent No.: US 8,733,302 B1
(45) Date of Patent: May 27, 2014

(54) VARIABLE COMPRESSION RATIO APPARATUS

(71) Applicant: Hyundai Motor Company, Seoul (KR)

(72) Inventors: Yoonsik Woo, Yongin-si (KR); Jin Kook Kong, Suwon-si (KR); Dong Seok Lee, Suwon-si (KR); Eun Ho Lee, Suwon-si (KR); Soo Hyung Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/710,259

(22) Filed: Dec. 10, 2012

(30) Foreign Application Priority Data

Nov. 2, 2012 (KR) ..... 10-2012-0123611

(51) Int. Cl.
*F02B 75/04* (2006.01)

(52) U.S. Cl.
USPC ..... 123/48 B; 123/78 BA; 123/197.1; 74/586

(58) Field of Classification Search
USPC ..... 123/48 B, 78 R, 78 E, 78 BA, 78 F, 78 A, 123/197.1, 197.3, 197.4; 74/586
See application file for complete search history.

(56) References Cited

U.S. PATENT DOCUMENTS 4,876,992 A * 10/1989 Sobotowski ..... 123/48 R
5,680,840 A * 10/1997 Mandella ..... 123/197.4
5,732,673 A * 3/1998 Mandella ..... 123/197.4
6,581,552 B2 * 6/2003 Kreuter ..... 123/48 R
7,028,647 B2 * 4/2006 Styron ..... 123/48 B
7,370,613 B2 * 5/2008 Lawrence et al. ..... 123/48 B
7,392,781 B2 * 7/2008 Takahashi et al. ..... 123/197.4
7,905,210 B2 * 3/2011 Eto et al. ..... 123/192.1
8,267,055 B2 * 9/2012 Pattakos et al. ..... 123/48 B
8,307,792 B2 * 11/2012 Scalzo ..... 123/48 B
8,387,573 B2 * 3/2013 Lee et al. ..... 123/48 B
8,393,307 B2 * 3/2013 Lee et al. ..... 123/48 B
8,397,684 B2 * 3/2013 Yang et al. ..... 123/48 R
8,434,435 B2 * 5/2013 Engineer ..... 123/48 B
8,468,997 B2 * 6/2013 Wilkins ..... 123/197.3
2010/0012095 A1 * 1/2010 Wilkins ..... 123/48 B

* cited by examiner

*Primary Examiner* — Noah Kamen
*Assistant Examiner* — Grant Moubry
(74) *Attorney, Agent, or Firm* — Morgan, Lewis & Bockius LLP

(57) ABSTRACT

A variable compression ratio apparatus may include a crankshaft, a connecting rod, first and second eccentric links mounted at both sides of the connection rod, respectively, and having one ends at which the piston pin may be eccentrically and rotatably installed, a swing link of which one end may be branched into two parts to form first and second branches, the first and second branches being connected to the other ends of the first and second eccentric links, and a control device connected to the other end of the swing link to control the swing link, wherein the crank arm includes guide surfaces formed in a predetermined thickness at an inner circumferential surface of the crank arm so that the first and second branches of the swing link slide to move between the guide surfaces.

16 Claims, 7 Drawing Sheets

VARIABLE COMPRESSION RATIO APPARATUS

CROSS-REFERENCE TO RELATED APPLICATION

The present application claims priority to Korean Patent Application No. 10-2012-0123611 filed on Nov. 2, 2012, the entire contents of which is incorporated herein for all purposes by this reference.

BACKGROUND OF THE INVENTION

1. Field of the Invention

The present invention relates to a variable compression ratio apparatus, and more particularly, to a variable compression ratio apparatus for varying a compression ratio of mixed gas inside a combustion chamber according to an operation state of an engine.

2. Description of Related Art

In general, when a compression ratio is high, thermal efficiency of a heat engine increases, and when an ignition timing advances to a predetermined level in a case of an ignition engine, thermal efficiency increases. However, when the ignition timing advances at a high compression ratio in a spark ignition engine, abnormal combustion is generated to cause damage to an engine. Accordingly, there is a limit in ignition timing advance, and it is necessary to bear output deterioration due to the limit.

The variable compression ratio (VCR) apparatus is an apparatus for changing a compression ratio of mixed gas according to an operation state of an engine. According to the variable compression ratio apparatus, fuel efficiency is improved by increasing a compression ratio of the mixed gas in a low load operation condition of the engine, and knocking generation is prevented and engine output is improved by decreasing the compression ratio of the mixed gas at a high load operation condition of the engine.

The variable compression ratio apparatus in the related art implements a change in a compression ratio by changing a length of a connecting rod connecting a piston and a crankshaft. In such a type of variable compression ratio apparatus, a part connecting the piston and the crankshaft is formed of several links, so that combustion pressure is directly transmitted to the links. Accordingly, durability of the links deteriorates.

As the results of various experiments for the variable compression ratio apparatus in the related art, it is revealed that operation reliability is improved by changing a distance between a crank pin and a piston pin by using an eccentric bearing.

A plurality of links is used in order to rotate the eccentric bearing, and there is a problem in that when the links are horizontally widened or separated when the piston descends. In the related art, a separate apparatus needs to be included in the connecting rod or the link in order to confine a movement trajectory of the link, so that there is a problem in that a structure of the connecting rod or the link is complicated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio apparatus having advantages of effectively confining a movement trajectory of a link rotating an eccentric bearing and simplifying a structure.

In an aspect of the present invention, a variable compression ratio apparatus mounted in an engine to change a compression ratio of mixed gas, may include a crankshaft configured to switch reciprocal movement of a piston by combustion power of the mixed gas to rotary movement, a connecting rod having one end in which a piston pin is inserted to be rotatably connected to the piston through the piston pin, and the other end rotatably connected to the crankshaft, first and second eccentric links mounted at both sides of the connection rod, respectively, and having one ends at which the piston pin is eccentrically and rotatably installed, a swing link of which one end is branched into two parts to form first and second branches, the first and second branches being connected to the other ends of the first and second eccentric links, and a control device connected to the other end of the swing link to control the swing link, wherein the crankshaft may include a crank journal rotatably supported by a cylinder block, a crank pin to which the other end of the connecting rod is rotatably connected, and a crank arm configured to connect the crank journal and the crank pin, and wherein the crank arm may include guide surfaces formed in a predetermined thickness at an inner circumferential surface of the crank arm so that the first and second branches of the swing link slide to move between the guide surfaces.

The guide surfaces are formed in a plane, wherein predetermined portions formed between the one ends and the other ends of the first and second branches are in shape of planes corresponding to the guide surfaces so as to slide between the guide surfaces.

Outer circumferential surfaces of the predetermined portions in the first and second eccentric links are shaped in planes protruding outwardly so as to slide between the guide surfaces.

The one ends of the first and second eccentric links may include eccentric bearings mounted between the one end of the connecting rod and the piston pin so that the piston pin eccentrically passes through the eccentric bearings.

The eccentric bearings are integrally formed with the first and second eccentric links.

The control device may include a control link of which one end is rotatably connected to the other end of the swing link, and a control shaft connected to the other end of the control link so as to pivot the control link.

The control link and the control shaft are integrally formed.

Each of one ends in the first and second branches is provided with branch portions divided into two parts, wherein each of the other ends in the first and second eccentric links is inserted in the corresponding branch portions to be rotatably connected thereto.

Each of the other ends in the first and second eccentric links is provided with branch portions divided into two parts, wherein each of one ends in the first and second branches are inserted in the corresponding branch portions to be rotatably connected thereto.

The guide surfaces are formed so as to extend from a lower portion of the crank pin to a large end of the crank arm to receive the connecting rod and the first and second branches therebetween.

The crank arm may include an extension portion extending in a radius direction at a small end so as to be in contact with an outer peripheral surface of a joint portion at which the first and second eccentric links are connected with the first and second branches, wherein the guide surfaces are formed in an inner circumferential surface of the extension portion so that the joint portion slides to move.

The variable compression ratio apparatus according to the exemplary embodiment of the present invention can effectively confine a movement trajectory of an eccentric link even without a separate device.

Further, the variable compression ratio apparatus according to an exemplary embodiment of the present invention has a simple structure, thereby improving operation stability and decreasing manufacturing costs.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
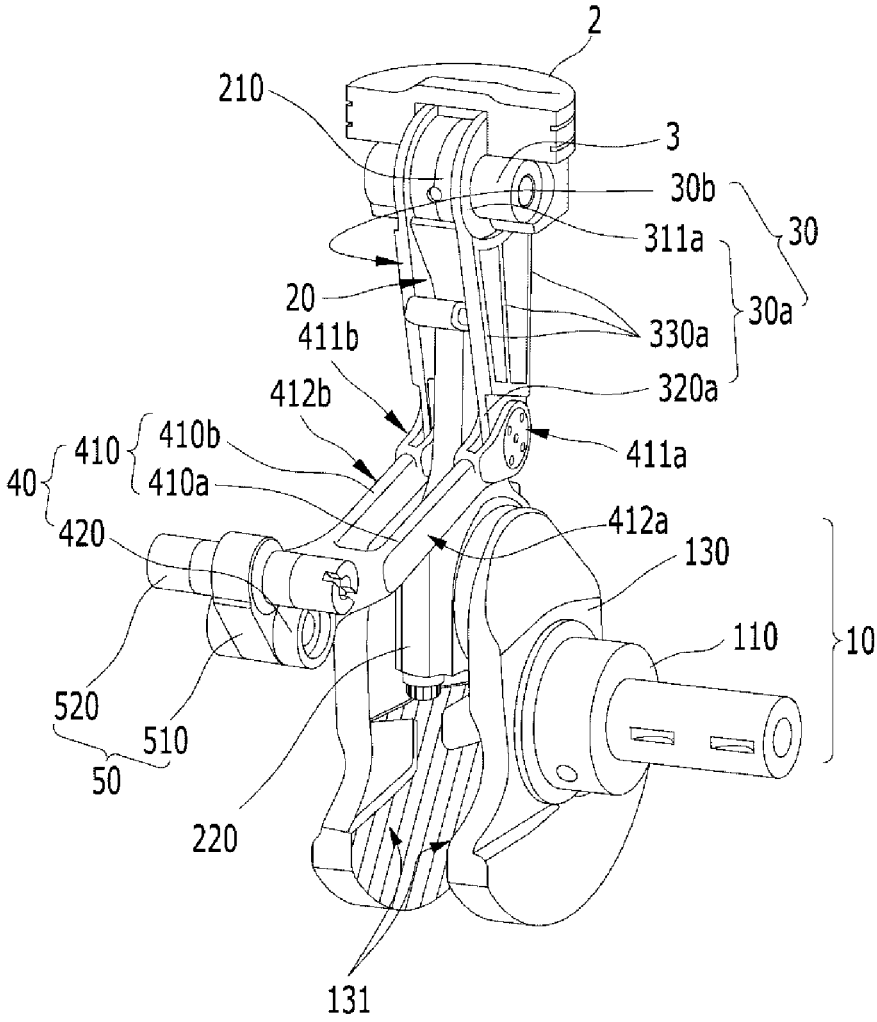
FIGS. 1 and 2 are perspective views schematically illustrating a variable compression ratio apparatus according to various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings.

The exemplary embodiment, which is an exemplary embodiment according to an exemplary embodiment of the present invention, may be implemented in various different forms, and thus the scope of the present invention is not limited to an exemplary embodiment to be described below.

Figure 2:
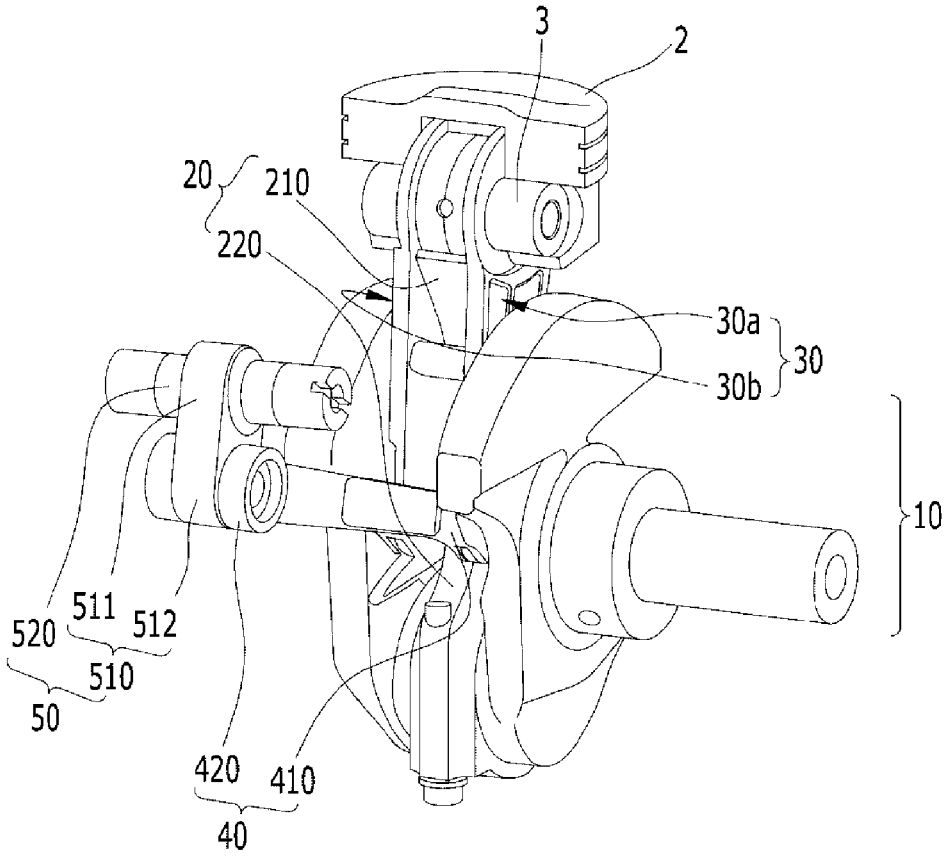
Figure 3:
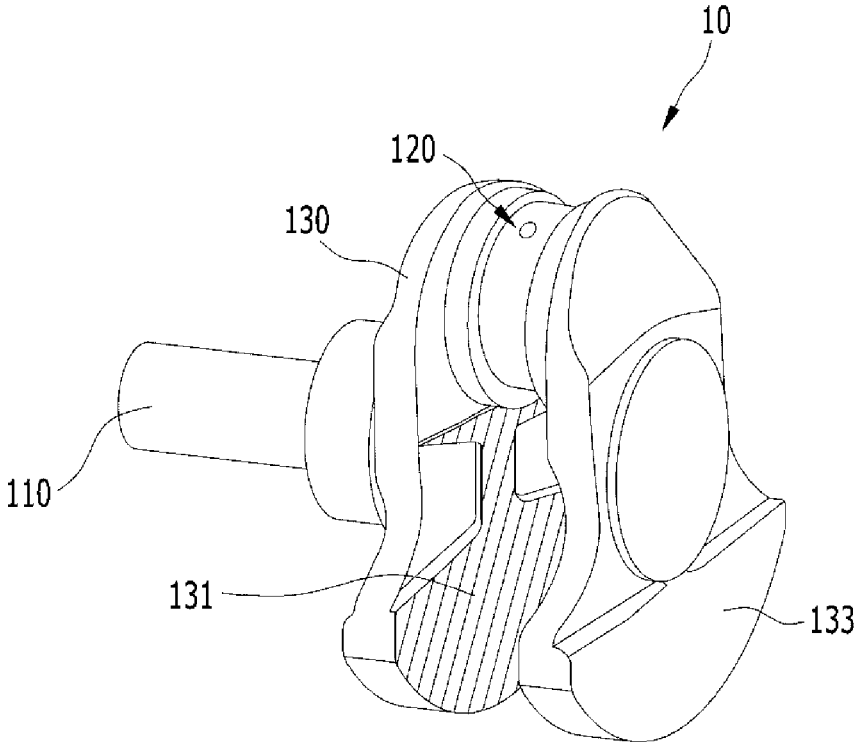
FIG. 3 is a perspective view schematically illustrating the crankshaft of a variable compression ratio apparatus according to the various exemplary embodiments of the present invention.
Figure 4:
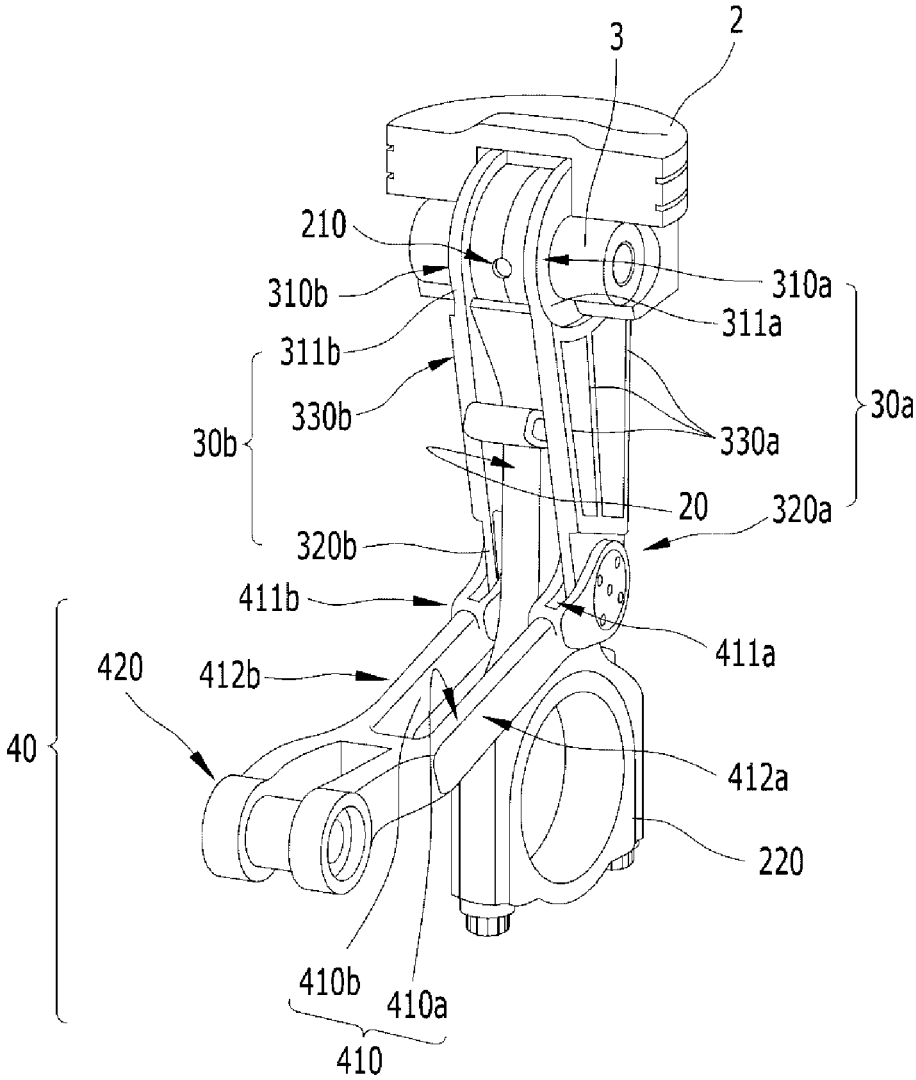
FIG. 4 is a perspective view schematically illustrating the remaining parts except for the crankshaft in the variable compression ratio apparatus according to the various exemplary embodiments of the present invention.

FIGS. 1 and 2 are perspective views schematically illustrating a variable compression ratio apparatus according to a first exemplary embodiment of the present invention, FIG. 3 is a perspective view schematically illustrating a crankshaft of the variable compression ratio apparatus according to the first exemplary embodiment of the present invention, and FIG. 4 is a perspective view schematically illustrating the remaining parts except for the crankshaft in the variable compression ratio apparatus according to the first exemplary embodiment of the present invention.

The variable compression ratio apparatus according to the first exemplary embodiment of the present invention is mounted in an engine for rotating a crankshaft by receiving combustion power of mixed gas from a piston to change a compression ratio.

As illustrated in FIGS. 1 to 4, the variable compression ratio apparatus 1 according to the first exemplary embodiment of the present invention may include a crankshaft 10, a connecting rod 20, an eccentric link 30, a swing link 40, and a control device 50.

The crankshaft 10 receives combustion power from a piston 2, converts the combustion power to torque, and transmits the converted torque to a transmission. The crankshaft 10 may be mounted inside a crank case formed at a lower end of a cylinder.

As illustrated in FIG. 3, the crankshaft 10 may include a crank journal 110 rotatably supported by a cylinder block of the engine, a crank pin 120 to which the connecting rod 20 is rotatably connected, and a crank arm 130 for connecting the crank journal 110 and the crank pin 120.

The crank pin 120 may be connected to a small end of the crank arm 130, and a balance weight 133 may be integrally mounted to a large end of the crank arm 130. The balance weight 133 decreases rotational vibration generated when the crankshaft 10 rotates.

According to the first exemplary embodiment of the present invention, a guide surface 131 formed in a predetermined thickness so that both side surfaces of the swing link 40 may slide to move may be included in an inner circumferential surface of the crank arm 130.

In one or multiple exemplary embodiments, as illustrated in FIG. 3, the guide surface 131 may extend from a side under the crank pin 120 to the large end of the crank arm 130 in which the balance weight 133 is formed. Further, the guide surface 131 may be formed in a plane, and may be integrally formed with an inner circumferential surface of the crank arm 130.

The connecting rod 20 receives combustion power from the piston 2 and transmits the received combustion power to the crankshaft 10.

According to the first exemplary embodiment of the present invention, the connecting rod 20 may include one end 210 and the other end 220. A piston pin 3 is inserted in the one end 210 of the connecting rod 20 so that the piston 2 is rotatably connected to the one end 210 of the connecting rod 20 through the piston pin 3, and the crankshaft 10 may be rotatably connected to the other end 220 of the connecting rod 20 by the crank pin 120.

The eccentric link 30 is connected with the piston 2 through the piston pin 3 and is rotated under the control of the control device 50 to change a compression ratio by adjusting a height of the piston 2 inside the cylinder.

According to the first exemplary embodiment of the present invention, the eccentric link 30 is a dual eccentric link and may include a first eccentric link 30*a* and a second eccentric link 30*b* symmetrically installed at both sides of the connecting rod 20 as illustrated in FIGS. 1 to 4.

Referring to FIGS. 1 to 4, the first and second eccentric links 30*a* and 30*b* may include one ends 310*a* and 310*b*, the other ends 320*a* and 320*b*, and predetermined portions 330*a* and 330*b* between the one ends 310*a* and 310*b* and the other ends 320*a* and 320*b*, respectively.

Referring to FIGS. 1 to 4, eccentric bearings 311*a* and 311*b* to which the piston pin 3 is eccentrically mounted may be integrally formed at the one ends 310*a* and 310*b* of the first and second eccentric links 30*a* and 30*b*, one end 410 of the swing link 40 may be rotatably connected to the other ends 320*a* and 320*b* of the first and second eccentric links 30*a* and 30*b*, and the predetermined portions 330*a* and 330*b* of the first and second eccentric links 30*a* and 30*b* may be formed in planes protruding outwardly so as to slide against the guide surface 131 of the crankshaft 10.

In one or multiple exemplary embodiments, as illustrated in FIGS. 1 to 4, the predetermined portions 330*a* and 330*b* of the first and second eccentric links 30*a* and 30*b* may be formed to be divided into three strings and outside surfaces thereof may be formed in a plane, to slide against the guide surface 131 of the crank arm 130 when the crankshaft 10 rotates. Since the predetermined portions 330*a* and 330*b* of the first and second eccentric links 30*a* and 30*b* are in close contact with the guide surface 131 of the crank arm 130 during sliding, movement trajectories of the first and second eccentric links 30*a* and 30*b* may be stably confined without a separate device.

The swing link 40 is installed between the control device 50 and the first and second eccentric links 30*a* and 30*b* to transmit control power of the control device 50 to the first and second eccentric links 30*a* and 30*b*.

The swing link 40 may include one end 410 and the other end 420. As illustrated in FIGS. 1 to 4, according to the first exemplary embodiment of the present invention, the one end 410 of the swing link 40 is branched into two parts to form a first branch 410*a* and a second branch 410*b*, and the other end 420 of the swing link 40 may be rotatably connected to the control device 50.

The first branch 410 and the second branch 410*b* of the swing link 40 may be rotatably connected to the other end 320*a* of the first eccentric link 30*a* and the other end 320*b* of the second eccentric link 30*b*, respectively. According to the first exemplary embodiment of the present invention, as illustrated in FIG. 1, one ends of the first branch 410*a* and the second branch 410*b* are divided into two parts to form branch portions 411*a* and 411*b*, respectively, and the other ends 320*a* and 320*b* of the first and second eccentric links 30*a* and 30*b* may be rotatably connected to the branch portions 411*a* and 411*b*, respectively.

In the meantime, predetermined portions 412*a* and 412*b* of the first and second branches 410*a* and 410*b* of the swing link 40 may be formed in planes corresponding to the guide surface 131 of the crank arm 130. As illustrated in FIGS. 1 to 2, the predetermined portions 412*a* and 412*b* may be formed in a substantially rectangle shape at side surfaces of the first and second branches 410*a* and 410*b*, and the predetermined portions 412*a* and 412*b* may be formed in a circular shape even at side surfaces of the branch portions 411*a* and 411*b*. When the crankshaft 10 rotates according to stroke of the piston 2, the guide surface 131 of the crankshaft 10 and the predetermined portions 412*a* and 412*b* of the first and second branches 410*a* and 410*b* mutually slide to prevent the first and second eccentric links 30*a* and 30*b* from horizontally moving. Accordingly, it is not necessary to install a special device for preventing the eccentric link from moving similarly to the related art, and thus it is possible to reduce costs and effectively confine a movement trajectory of the eccentric link according to a simple structure.

The control device 50 is connected to the other end 420 of the swing link 40 to control the swing link 40, thereby varying the compression ratio.

The control device 50 may include a control link 510 and a control shaft 520. The control link 510 includes one end 511 and the other end 512, the other end 420 of the swing link 40 is rotatably connected to the one end 511 of the control link 510 and the control shaft 520 is coupled to the other end 512 of the control link 510. Accordingly, the swing link 40 and the first and second eccentric links 30*a* and 30*b* sequentially rotate according to rotation of the control shaft 520, thereby varying a compression ratio.

Figure 5:
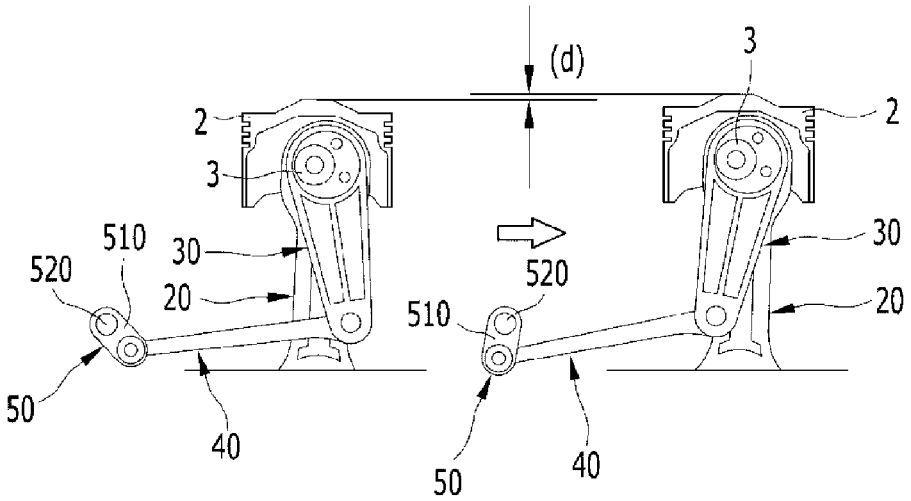
FIG. 5 is a view schematically illustrating a change in a height of a piston according to an exemplary embodiment of the present invention.

FIG. 5 is a view exemplarily illustrating variance in a height of the piston 2 according to the first exemplary embodiment of the present invention. FIGS. 5A and 5B illustrate a change in a height of the piston 2 according to rotation of the control device 50.

For example, when the control shaft 520 of the control device 50 rotates clockwise from FIG. 5A to FIG. 5B, the control link 510 rotates clockwise, accordingly. The swing link 40 is rotatably connected to the one end 511 of the control link 510, and the first and second eccentric links 30*a* and 30*b* are rotatably connected to the one end 410 of the swing link 40. Accordingly, the first and second eccentric links 30*a* and 30*b* and the eccentric bearings 311*a* and 311*b* also rotate clockwise, so that a height of the piston 2 increases by predetermined length d and thus a compression ratio is changed.

Figure 6:
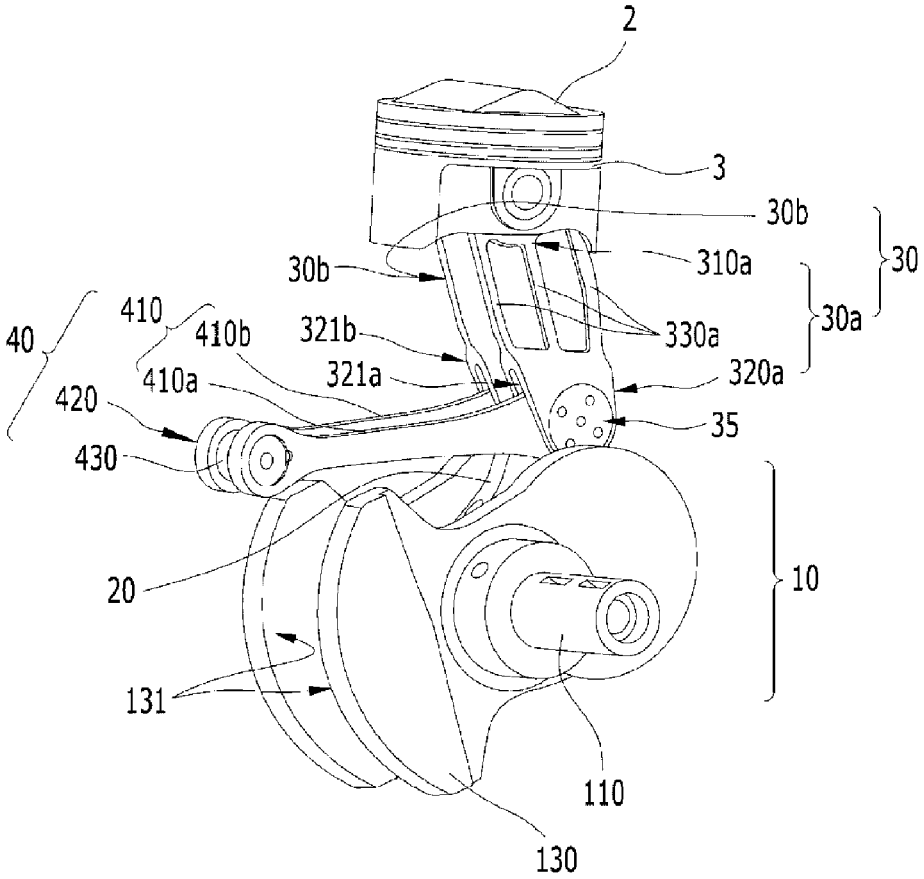
FIG. 6 is a perspective view schematically illustrating a variable compression ratio apparatus according to various exemplary embodiments of the present invention.
Figure 7:
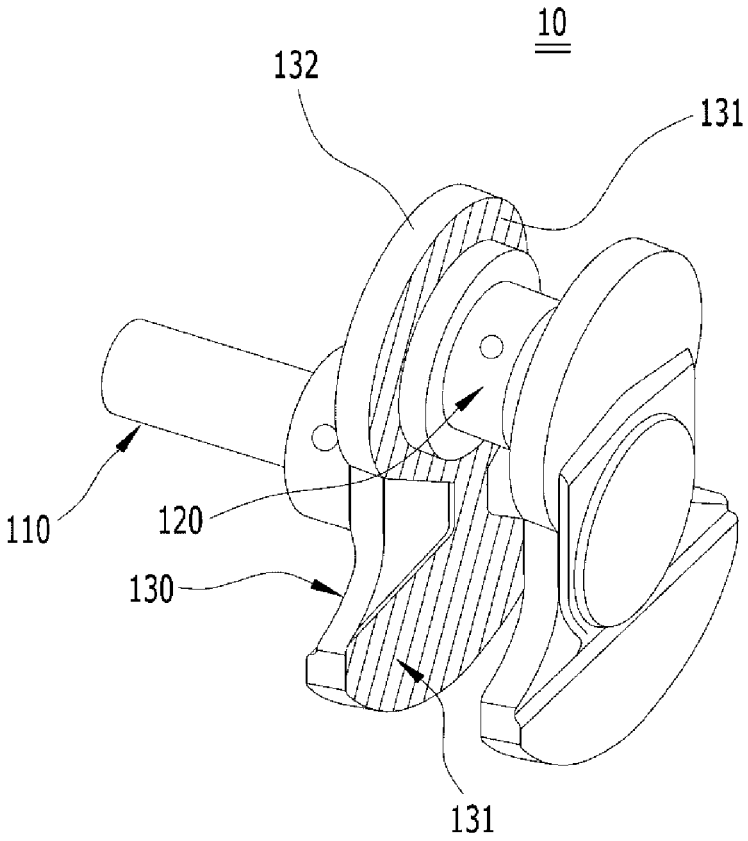
FIG. 7 is a perspective view schematically illustrating a crankshaft of the variable compression ratio apparatus according to the various exemplary embodiments of the present invention.

FIG. 6 is a perspective view schematically illustrating a variable compression ratio apparatus according to a second exemplary embodiment of the present invention, and FIG. 7 is a perspective view schematically illustrating a crankshaft of the variable compression ratio apparatus according to the second exemplary embodiment of the present invention.

The variable compression ratio apparatus 1 according to the second exemplary embodiment of the present invention is mounted to an engine for rotating a crankshaft 10 by receiving combustion power of mixed gas from a piston 2, and may include the crankshaft 10, a connecting rod 20, an eccentric link 30, a swing link 40, and a control device 50, similar to that of the first exemplary embodiment.

The eccentric link 30 may include a first eccentric link 30*a* and a second eccentric link 30*b*, the swing link 40 may include a first branch 410*a* and a second branch 410*b*, and the control device 50 may include a control shaft 520 and a control link 510.

Further, the crankshaft 10 may include a crank journal 110 rotatably supported by a cylinder block of the engine, a crank pin 120 to which the connecting rod 20 is rotatably connected, and a crank arm 130 for connecting the crank journal 110 and the crank pin 120. A guide surface 131 may be formed in a predetermined thickness in the inner circumferential surface of the crank arm 130 so that the first and second branches 410*a* and 410*b* may slide to move.

A general configuration of the variable compression ratio apparatus according to the second exemplary embodiment of the present invention is substantially the same as that of the first exemplary embodiment. Accordingly, a part of the configuration of the second exemplary embodiment different from that of the first exemplary embodiment will be described below in priority.

As illustrated in FIG. 6, in the variable compression ratio apparatus 1 according to the second exemplary embodiment of the present invention, branch portions 321*a* and 321*b* divided into two parts are formed at the other ends 320*a* and 320*b* of the first and second eccentric links 30*a* and 30*b* such that one ends of the first and second branches 410*a* and 410*b* are inserted, respectively, and one ends of the first and second branches 410*a* and 410*b* are inserted between the branch portions 321*a* and 321*b* to be rotatably connected.

Accordingly, as illustrated in FIG. 6, a joint portion 35 at which the first and second eccentric links are connected with the first and second branches 410*a* and 410*b* is formed at the branch portions 321*a* and 321*b*.

In the variable compression ratio apparatus 1 according to the second exemplary embodiment of the present invention, the crank arm 130 of the crankshaft 10 includes an extension portion 132 extending in a radius direction at a small end so as to be in contact with an outer circumferential surface of the joint portion 35.

Further, the guide surface 131 is formed in the inner circumferential surface of the extension portion 132 so that the joint portion 35 may slide to move.

In one or multiple exemplary embodiments, as illustrated in FIG. 6 or 7, the extension portion 132 may be formed in a predetermined size so as to be in contact with one portion of a lower portion of the joint portion 35.

Accordingly, as illustrated in FIG. 6, even when the guide surface 131 formed at a large end of the crank arm 130 does not slide against the first and second eccentric links 30*a* and 30*b* and the first and second branches 410*a* and 410*b*, the movement trajectories of the first and second eccentric links 30*a* and 30*b* may be continuously confined by the extension portion 132 formed at the small end of the crank arm 130. Thus, according to the second exemplary embodiment of the present invention, it is possible to effectively confine horizontal movement of the first and second eccentric links 30*a* and 30*b*.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus mounted in an engine to change a compression ratio of mixed gas, comprising:

a crankshaft configured to switch reciprocal movement of a piston by combustion power of the mixed gas to rotary movement;

a connecting rod having one end in which a piston pin is inserted to be rotatably connected to the piston through the piston pin, and the other end rotatably connected to the crankshaft;

first and second eccentric links mounted at both sides of the connection rod, respectively, and having one ends at which the piston pin is eccentrically and rotatably installed;

a swing link of which one end is branched into two parts to form first and second branches, the first and second branches being connected to the other ends of the first and second eccentric links; and a control device connected to the other end of the swing link to control the swing link;

wherein the crankshaft includes a crank journal rotatably supported by a cylinder block crank pin to which the other end of the connecting rod is rotatably connected, and a crank arm configured to connect the crank journal and the crank pin;

wherein the crank arm includes guide surfaces formed in a predetermined thickness at an inner circumferential surface of the crank arm so that the first and second branches of the swing link move between the guide surfaces;

wherein each of one ends in the first and second branches is provided with branch portions divided into two parts; and wherein each of the other ends in the first and second eccentric links is inserted in the corresponding branch portions to be rotatably connected thereto.

2. The variable compression ratio apparatus of claim 1, wherein the guide surfaces are formed in a plane, and wherein predetermined portions formed between the one ends and the other ends of the first and second branches are in shape of planes corresponding to the guide surfaces so as to slide between the guide surfaces.

3. The variable compression ratio apparatus of claim 2, wherein outer circumferential surfaces of the predetermined portions in the first and second eccentric links are shaped in planes protruding outwardly so as to slide between the guide surfaces.

4. The variable compression ratio apparatus of claim 1, wherein the one ends of the first and second eccentric links include eccentric bearings mounted between the one end of the connecting rod and the piston pin so that the piston pin eccentrically passes through the eccentric bearings.

5. The variable compression ratio apparatus of claim 4, wherein the eccentric bearings are integrally formed with the first and second eccentric links.

6. The variable compression ratio apparatus of claim 1, wherein the control device includes:

a control link of which one end is rotatably connected to the other end of the swing link; and a control shaft connected to the other end of the control link so as to pivot the control link.

7. The variable compression ratio apparatus of claim 6, wherein the control link and the control shaft are integrally formed.

8. A variable compression ratio apparatus mounted in an engine to change a compression ratio of mixed gas, comprising:

a crankshaft configured to switch reciprocal movement of a piston by combustion power of the mixed gas to rotary movement;

a connecting rod having one end in which a piston pin is inserted to be rotatably connected to the piston through the piston pin, and the other end rotatably connected to the crankshaft;

first and second eccentric links mounted at both sides of the connection rod, respectively, and having one ends at which the piston pin is eccentrically and rotatably installed;

a swing link of which one end is branched into two parts to form first and second branches, the first and second branches being connected to the other ends of the first and second eccentric links; and a control device connected to the other end of the swing link to control the swing link;

wherein the crankshaft includes a crank journal rotatably supported by a cylinder block, a crank pin to which the other end of the connecting rod is rotatably connected, and a crank arm configured to connect the crank journal and the crank pin;

wherein the crank arm includes guide surfaces formed in a predetermined thickness at an inner circumferential surface of the crank arm so that the first and second branches of the swing link move between the guide surfaces;

wherein each of the other ends in the first and second eccentric links is provided with branch portions divided into two parts; and wherein each of one ends in the first and second branches are inserted in the corresponding branch portions to be rotatably connected thereto.

9. The variable compression ratio apparatus of claim 1, wherein the guide surfaces are formed so as to extend from a lower portion of the crank pin to a large end of the crank arm to receive the connecting rod and the first and second branches therebetween.

10. The variable compression ratio apparatus of claim 1, wherein the crank arm includes an extension portion extending in a radius direction at a small end so as to be in contact with an outer peripheral surface of a joint portion at which the first and second eccentric links are connected with the first and second branches, and wherein the guide surfaces are formed in an inner circumferential surface of the extension portion so that the joint portion slides to move.

11. The variable compression ratio apparatus of claim 8, wherein the guide surfaces are formed in a plane, and wherein predetermined portions formed between the one ends and the other ends of the first and second branches are in shape of planes corresponding to the guide surfaces so as to slide between the guide surfaces.

12. The variable compression ratio apparatus of claim 8, wherein outer circumferential surfaces of the predetermined portions in the first and second eccentric links are shaped in planes protruding outwardly so as to slide between the guide surfaces.

13. The variable compression ratio apparatus of claim 8, wherein the one ends of the first and second eccentric links include eccentric bearings mounted between the one end of the connecting rod and the piston pin so that the piston pin eccentrically passes through the eccentric bearings.

14. The variable compression ratio apparatus of claim 13, wherein the eccentric bearings are integrally formed with the first and second eccentric links.

15. The variable compression ratio apparatus of claim 8, wherein the control device includes:

a control link of which one end is rotatably connected to the other end of the swing link; and a control shaft connected to the other end of the control link so as to pivot the control link.

16. The variable compression ratio apparatus of claim 15, wherein the control link and the control shaft are integrally formed.

* * * * *